US008690694B2

(12) United States Patent
Barber

(10) Patent No.: US 8,690,694 B2
(45) Date of Patent: Apr. 8, 2014

(54) FREE FALL AMUSEMENT RIDE

(76) Inventor: Gerald L. Barber, Greenville, SC (US)

( * ) Notice: Subject to any disclaimer, the term of this patent is extended or adjusted under 35 U.S.C. 154(b) by 162 days.

(21) Appl. No.: 13/181,215

(22) Filed: Nov. 17, 2011

(65) Prior Publication Data

US 2013/0130817 A1 May 23, 2013

(51) Int. Cl.
*A63G 31/00* (2006.01)
*A63G 27/00* (2006.01)

(52) U.S. Cl.
USPC ..... 472/50; 472/2; 472/3

(58) Field of Classification Search
USPC ..... 472/2–3, 39, 421, 131, 136, 21, 50
See application file for complete search history.

(56) References Cited

U.S. PATENT DOCUMENTS 5,046,719 A * 9/1991 Comstock et al. ..... 472/49
5,564,983 A * 10/1996 Larson ..... 472/3
5,628,690 A * 5/1997 Spieldiener et al. ..... 472/131
6,315,674 B1 * 11/2001 Slade et al. ..... 472/131
6,755,749 B2 * 6/2004 Stengel ..... 472/50

* cited by examiner

*Primary Examiner* — Kien Nguyen
(74) *Attorney, Agent, or Firm* — McNair Law Firm, P.A.; Douglas W. Kim

(57) ABSTRACT

An amusement ride apparatus comprising: a free fall tower having a proximal end hingedly attached to a base platform and a distal end; a lifting assembly connected to the base platform and the free fall tower so that the free fall tower can transition between a loading position and a free fall position; a trolley slideably attached to the free fall tower; a trolley securing assembly attached to the trolley and releasably attached to the distal end of the tower for securing the trolley to the distal end prior to the free fall tower transitioning from the loading position to the free fall position so that the trolley is held at the distal end when the tower is in the free fall position; a braking assembly carried by the base platform for slowing the downward movement of the trolley when the trolley securing member is released; and, a passenger carriage pivotably carried by the trolley allowing the passenger carriage to pivot to maintain a generally upright orientation as the free fall tower transitions from the loading position to the free fall position.

21 Claims, 9 Drawing Sheets

FREE FALL AMUSEMENT RIDE

BACKGROUND OF THE INVENTION

1) Field of the Invention

The present invention relates to an amusement ride. More specifically, the invention relates to a portable free fall amusement ride.

2) Description of Related Art

Amusement rides, including free fall amusement rides that use gravity to provide a sensation of weightlessness are well known in the art. However, such rides are either immobile or have limited portability due to the equipment used to lift the passenger cart from the bottom of the ride to the top of the ride where it can be "dropped."

Accordingly, it is an object of the present invention to provide a free fall amusement ride that is easily transported from one location to the next.

It is another object to provide a free fall amusement ride that utilizes gravity to transport the passenger cart from the bottom of the ride to the top of the ride so that it can be dropped.

SUMMARY OF THE INVENTION

The above objectives are accomplished according to the present invention by providing an amusement ride comprising: a free fall tower hingedly attached to a mobile base platform having a distal end and a proximate end; a lifting assembly connected to said mobile base platform and said free fall tower for transitioning said free fall tower from a loading position and a free fall position; a passenger carriage slideably attached to said free fall tower and releasably connected to said distal end so that passengers can board said passenger carriage when said free fall tower is in said loading position; and, a braking assembly carried by said free fall tower for stopping said passenger carriage when said passenger carriage is released from said distal end and said free fall tower is in said free fall position. The invention can includes a trolley disengagement arm connected to said mobile base platform and slideably connected to said free fall tower so that said trolley disengagement arm moves said passenger carriage outside a braking zone as said free fall tower transitions from said free fall position to said loading position. The invention can include an upper free fall tower portion hingedly connected to a lower free fall portion so that said free fall tower can be rotated into a folded arrangement for storage or transportation. The invention can include a trolley pivotably connected to said passenger carriage so that said passengers' orientation remains generally upright as The invention can include a track carried by said free fall tower and associated with said trolley disengagement arm for allowing said trolley disengagement arm to slide along said free fall tower. The invention can includes a releasable latch carried at said distal end of said free fall tower for securing said passenger carriage to said distal end when said free fall tower is in said loading position and transitioning to said free fall position.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention.

Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

Figure 1:
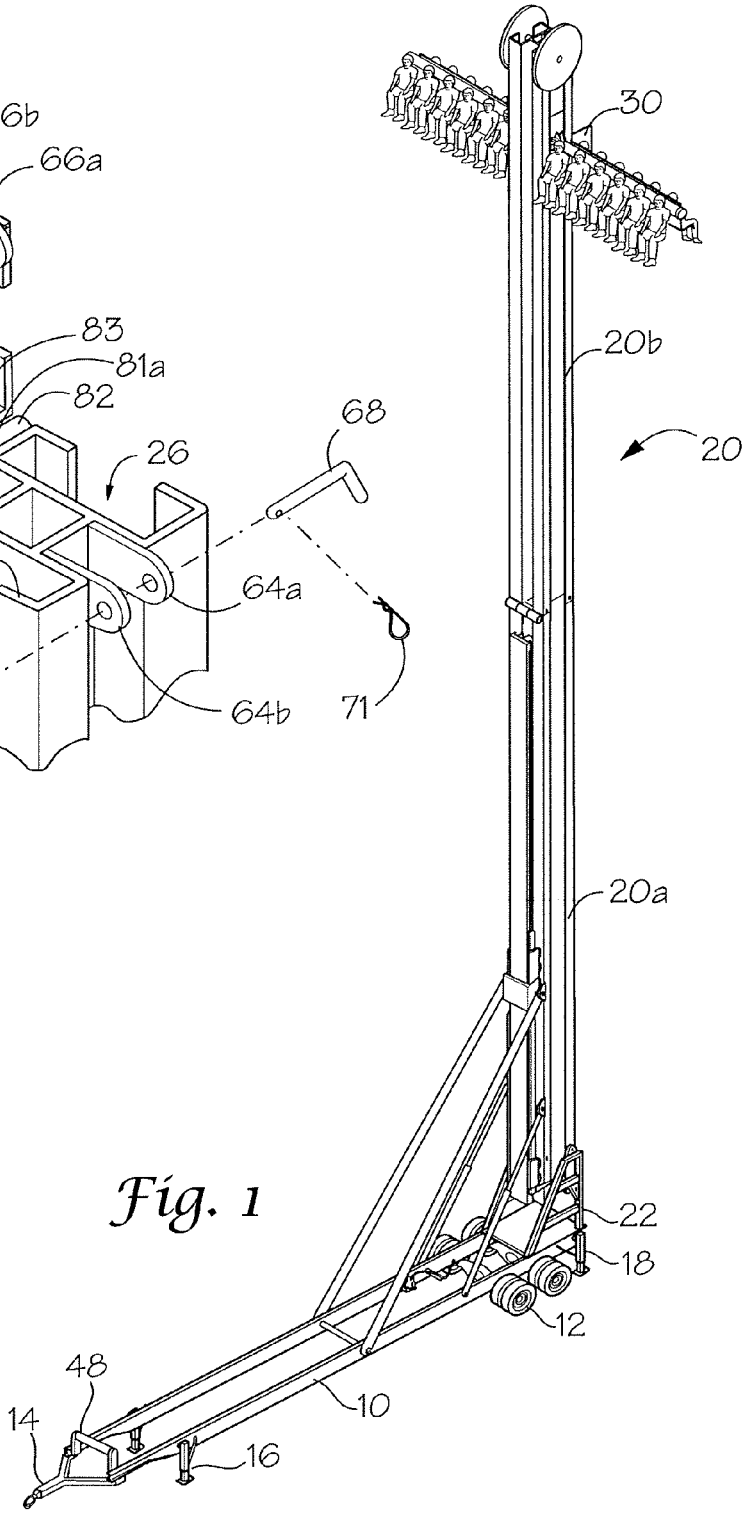
FIG. 1 shows a perspective view of the present invention in an erect position.

With reference to the drawings, the invention will now be described in more detail. Referring now to FIG. 1, the present invention is shown generally as A. The invention includes a mobile base platform 10 having at least one set of wheels 12 (FIG. 6), but preferably two sets or more. The base platform also includes a hitch 14 for engaging a vehicle's receiver or similar devices that are known in the art so that the invention may be transported by attaching the base platform to an appropriate vehicle. Two sets of leg braces 16 and 18 are pivotably carried by the base platform so that when not being transported, the braces may be rotated downwardly towards the ground and support the base platform. In alternate embodiments, the braces could be telescoping or releaseably secured to the base platform.

A free fall tower 20 is pivotably carried by the rear end of the base that is opposite from the hitch 14. In one embodiment, the free fall tower includes a lower section 20*a* that is pivotably connected to the platform 10 and an upper section 20*b* that is pivotably connected to the flower section. In the shown embodiment, the lower section of the free fall tower is pivotably carried by a riser 22 that is disposed at the rear end of the base platform and generally above the rear set of braces 18. This riser allows the lower section of the free fall tower to rotate without being obstructed by the base platform.

Figure 2:
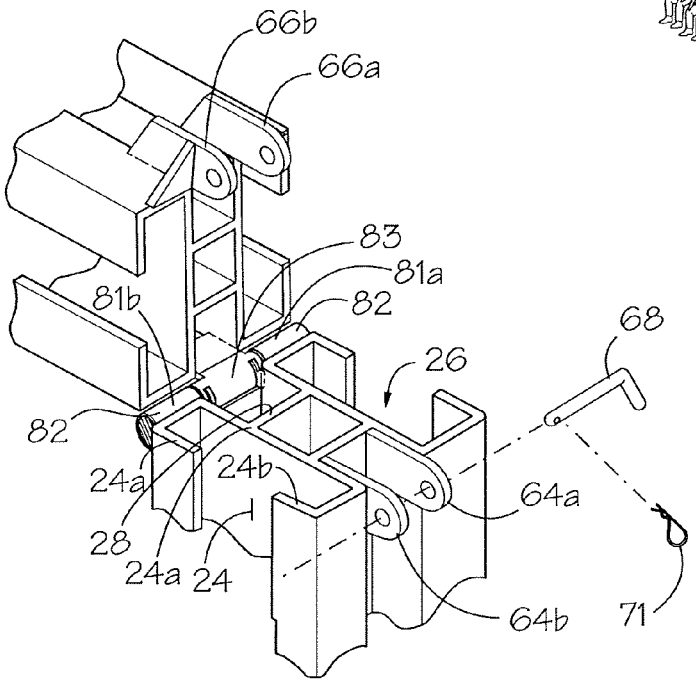
FIG. 2 shows a cross sectional perspective view of the free fall tower of the present invention.

As can be seen in FIGS. 1 and 2, free fall tower 20 includes two generally "C" shaped channels 24 and 26 carried by the free fall tower. One mirrors the other and are interconnected by a post 28. Because the "C" shaped channels are substantially identical, only the structure of the first channel 24 will be described. The first channel is formed by a back side 24*a*, two opposing sides that extend generally perpendicular from the back side 24*a* and two front side segments 24*b* and 24*c* that are laterally spaced from one another and are generally opposite and parallel to the back side. The post 28 interconnects the two "C" shaped channels 24 and 26 and is disposed between the back sides of the channels and runs along the longitudinal length of the free fall tower segments. Channels 24 and 26 are adapted to receive a passenger carriage 30 and to allow the passenger carriage to travel within the channels and along the length of the free fall tower.

Lower portion 20*a* can be hingedly connected to upper portion 20*b* by hinge 82. The hinge can have a permanent hinge pin or removable hinge pin to secure the hinge rounds or knuckle of the lower and upper portions.

Passenger carriage 30, which is pivotably connected to the trolley, is allowed to freely rotate with respect to the trolley and thus the free fall tower 20 as it moves along the free fall tower. As discussed more fully with respect to FIG. 5, this pivotal connection allows the passengers seated in the passenger carriage to remain in an upright position with respect to the ground while the free fall tower is rotated from the free fall position shown in FIG. 1 into the loading position shown in FIG. 3.

Referring to FIGS. 3A through 3E, the bottom portion 20*a* of the free fall tower includes a braking assembly that is disposed within a braking area (generally shown as B in FIGS. 2-3). In one embodiment, the braking assembly comprises permanent magnets 32 that provide a sufficiently powerful magnetic field to stop the passenger carriage 30 after it is dropped from the upper portion 20*b* of the free fall tower. In this embodiment, no external power is required for providing the braking function. In one embodiment, the braking area B consist approximately 25 feet of the bottom portion 20*a* of the free fall tower. In one embodiment, the permanent magnets are disposed within the braking area and on the interior surface of the back sides 24*a* and 26*a* of the channels 24 and 26. As discussed more fully below, when the passenger carriage enters into the braking area, the magnets 32 begin to slow the passenger carriage 30 until it comes to a stop near the bottom of the first bottom portion 20*a* of the free fall tower. In alternate embodiments, the braking assembly could be carried by the base platform 10 and could comprise electro magnets, a hydraulic arm and/or an air compression system.

Figure 3B:
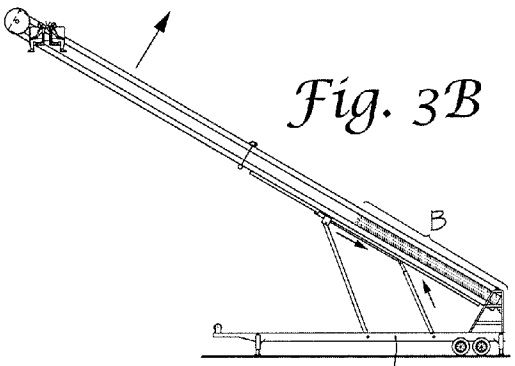
FIGS. 3A through 3E show a side elevation view of the present invention in various positions.
Figure 3E:
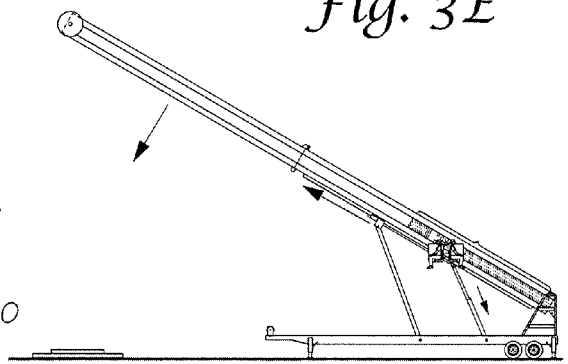
Figure 3A:
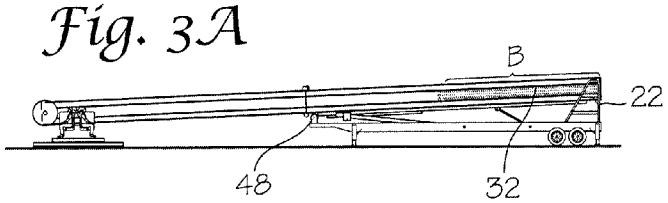
Figure 3D:
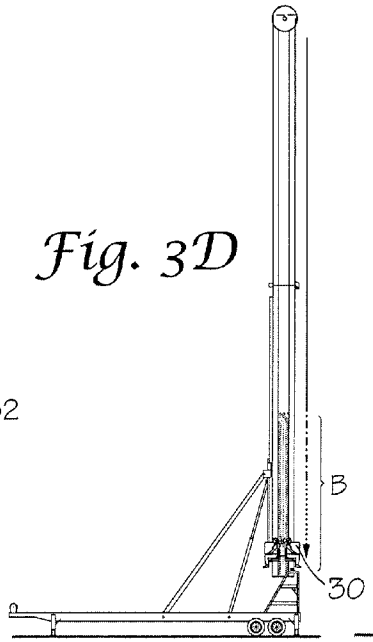
Figure 3C:
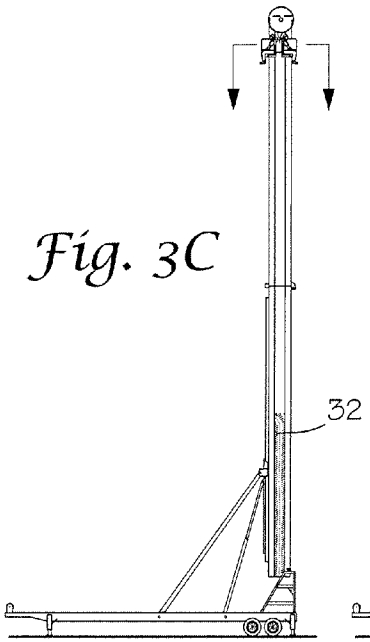
Figure 4:
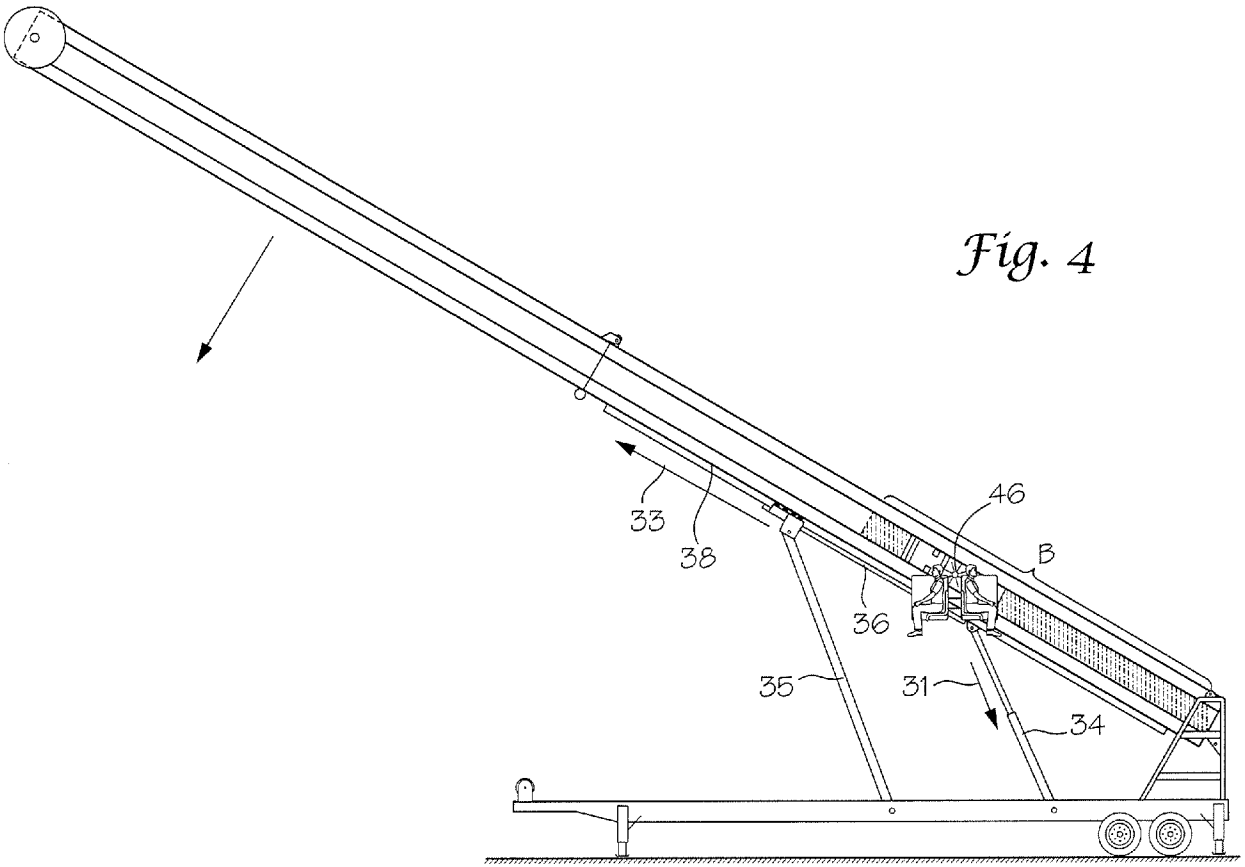
FIG. 4 shows a side elevation view of the present invention in a loading position.

As can be seen in FIG. 4, the invention further includes a lifting assembly 34. The lifting assembly can be a hydraulic piston to transition the free fall tower from the loading position to the erect position. A track 38 is carried by the lower portion of the free fall tower. A trolley disengaging arm 36 is carried by the track and responsible for transporting the passenger carriage 30, which is pivotably and slideably connected to the free fall tower 20, from the bottom portion 20*a* of the free fall tower to the upper portion 20*b* when the free fall tower is placed in the loading position shown in FIG. 3.

In the embodiment shown in FIGS. 2 and 4, the lifting assembly 34 has a first end that is pivotably connected to the base platform 10 and a second end that is slideably connected to the lower portion of the free fall tower. In one embodiment, the lifting assembly 34 comprises a lift arm that is a hydraulically powered, telescopic arm that may rotate with respect to the base platform as well as change its length by telescoping. In other embodiments, however, the lift arm can be mechanically operated by a motor, gears, cables or other means generally known in the art and can have a fixed length.

Figure 7:
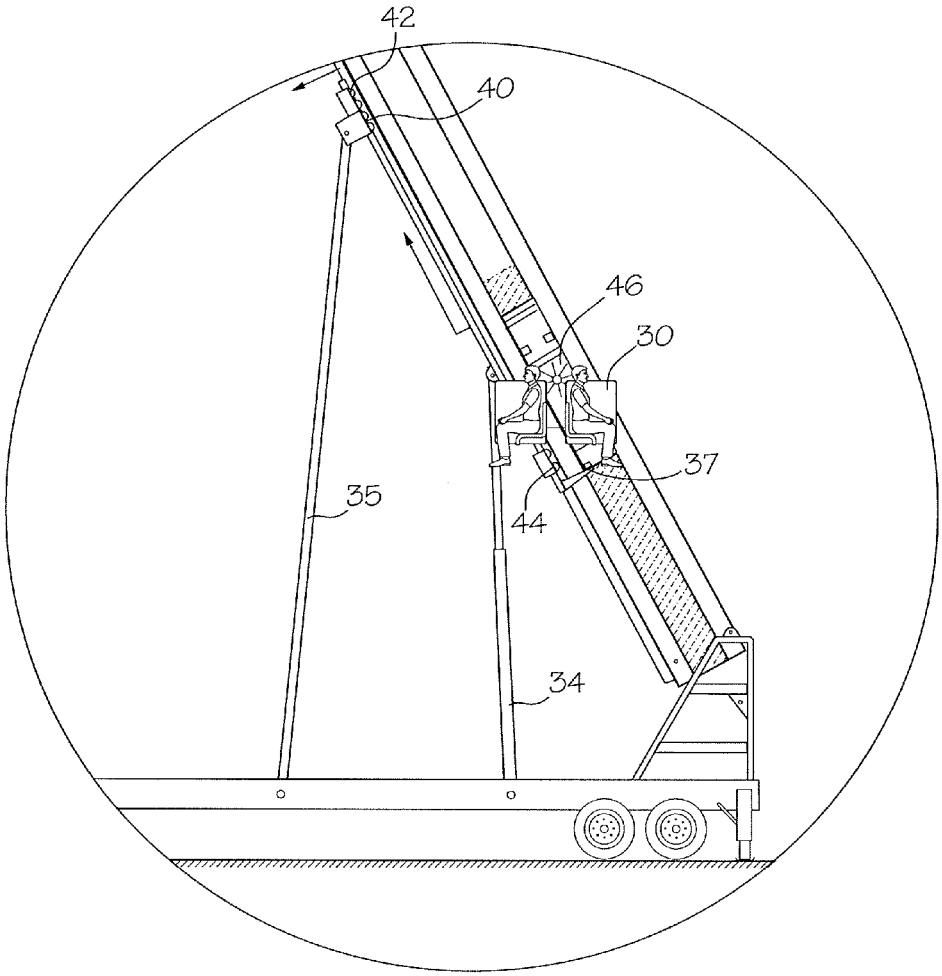
FIG. 7 shows a side view of portions of the invention.

Track 38 to which the trolley disengaging arm 36 is slideably connected, is disposed along a predetermined length of the bottom portion 20*a* of the free fall tower. In one embodiment, track 38 extends 50 feet upwards from the proximal end of bottom portion 20*a* towards upper portion 20*b* of the free fall tower. In one embodiment, the track comprises an "I" beam that is adapted to receive wheels 40 (FIG. 7) that are pivotably connected to a lifting assembly arm 35. These wheels 40 allow the trolley disengaging arm to slide up and down track 38 as the lifting arm 35 rotates with respect to the base platform 10.

In one embodiment, the trolley disengaging arm 36 includes two sets of wheels 42 and 44 that are located at each end of the trolley disengaging arm and allow the trolley disengaging arm to readily slide along the length of track 38. The trolley disengaging arm further includes a stop 37 that is disposed generally adjacent to the trolley disengaging arm's lower wheels 42. This stop is designed to engage the passenger carriage 30 so that as the trolley disengaging arm slides up the track, the trolley disengaging arm will engage the passenger carriage and push the passenger carriage along the free fall tower toward the loading position.

The trolley disengaging arm 36 may also include a locking mechanism disposed generally adjacent to the stop. The locking mechanism can include a locking pin, latch or other means generally known in the art. In one embodiment, the locking mechanism is manually operated so that once the passenger carriage 30 comes to a stop at the bottom of the free fall tower 20, the ride operator can engage the locking mechanism and secure the passenger carriage 30 to the trolley disengaging arm. In another embodiment, the locking mechanism is designed to automatically secure the trolley to the trolley disengaging arm 36 once the passenger carriage 30 comes to a stop at the bottom of the free fall tower 20.

Once the trolley disengaging arm contacts trolley 46, the lifting assembly 34 may be used to lower the free fall tower 20 from the free fall position to the loading position, shown as direction 31. As the lifting assembly 34 pivots downwards, it causes the free fall tower 20 to rotate so that the upper portion 20*b* of the tower is placed closer to the ground. As the free fall tower 20 rotates, the trolley disengaging arm 36 slides along track 38.

As the trolley disengaging arm 36 moves up the track in a direction shown as 33, the trolley disengaging arm causes the passenger carriage 30 and trolley 46 to be pushed through braking area B as the trolley travels in a direction 33 along the free fall tower. By using the force of gravity or a mechanically assisted lifting assembly, the passenger carriage may pass through the braking area and past the permanent magnets designed to stop the passenger carriage as it nears the proximal end of the free fall tower and thus the ground. Since in one embodiment, the magnets are permanent magnets rather the electro-magnets, the lifting assembly 34 and trolley disengaging arm 36 are necessary to pull the passenger carriage 30 through the magnetic field created by those magnets.

As can be seen in FIG. 3E, as the lifting assembly 34 continues to rotate, the upper portion 20*b* of the free fall tower is moved closer to the ground until it reaches the loading position, at which point the free fall tower is stopped by the tower stoppers 48. The tower stoppers 48 are disposed on the platform and designed to help prevent the free fall tower from rotating any further once it is in the loading position and to reduce the strain on the lifting assembly 34 when the free fall tower is in the loading position. When in the loading position, the distal end of the upper portion 20*a* is closer to the ground than the proximal end of the lower portion 20*b* that is pivotably connected to the riser 22. This difference in height is caused by the difference in height between the riser 22 and the tower stoppers 48.

Figure 5:
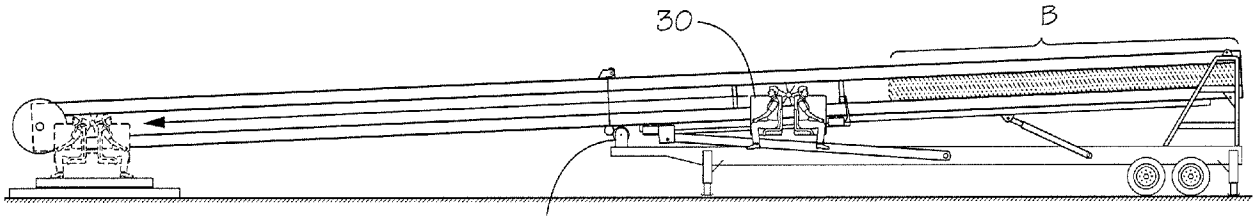
FIG. 5 shows a side view of the invention.

Once the free fall tower is placed in the loading position, the trolley disengaging arm has advanced to the end of track 38 and has pulled the passenger carriage 30 through the braking area B (FIG. 5). Because the loading position places the free fall tower 20 in a slanted position where the upper portion 20*a* is lower than the lower portion 20*b* of the free fall tower, the passenger carriage 30 is free to slide from the lower portion 20*b* of the free fall tower to the distal end of the upper portion 20*a* after the locking mechanism is released.

In one embodiment, the passenger carriage can be secured to the trolley to prevent its rotation about the trolley. When secured in a loading position, the passenger carriage allows passengers to mount and dismount the passenger carriage without it rotating. When in the free fall position, the passenger carriage can travel downwards with the passengers oriented feet down relative to the base platform.

Figure 8:
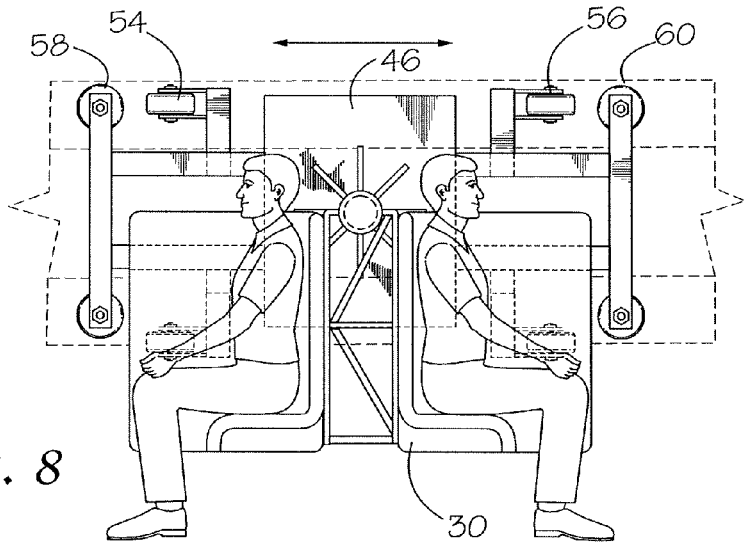
FIG. 8 shows a side view of a portion of the present invention in a horizontal position.
Figure 9:
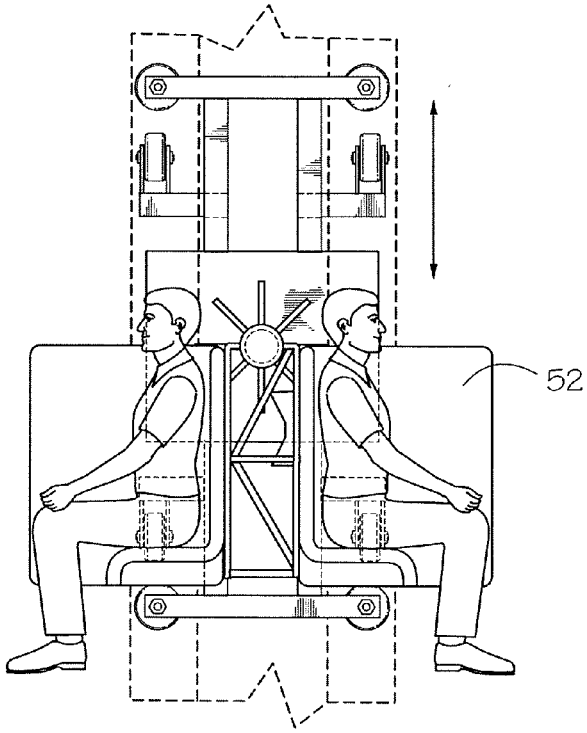
FIG. 9 shows a side view of a portion the present invention in a vertical position.

After the passengers have loaded onto the ride, as shown in FIG. 8, the lifting assembly may then rotate in a clockwise manner causing the free fall tower 20 to be placed in the erect, free fall position shown in FIG. 9. As the free fall tower is rotated, the trolley disengaging arm 36 slides back towards the proximal end of the free fall tower that is pivotably connected to the platform 10. Once the free fall tower is placed in the fully erect, free fall position, the passenger carriage may be dropped from the upper portion 20*a* and the process may be repeated.

The lifting arm can be pivotably connected to the disengagement arm that is slideably connected to the track.

Referring now to FIGS. 8 and 9, the trolley 46 includes a first set of side wall wheels 54 and a second set of side wall wheels 56 opposing the first set. Each of these wheel sets contacts the side walls 26*a* and 26*e* of the free fall tower 20. The trolley further includes a first and second set of front wall wheels 58 and 60. While only one of the wheels in each respective sets 58 and 60 are shown, each set 58 and 60 include another wheel that opposes the wheels. The front wall wheels are intended to contact the front segments 26*c* and 26*d* of the free fall tower as well as the back wall 26*a* of the free fall tower. Each set of wheels 54, 56, 58, and 60 engage the inner walls of the free fall tower as described above and allow the trolley to slide along the length of the free fall tower.

Figure 6:
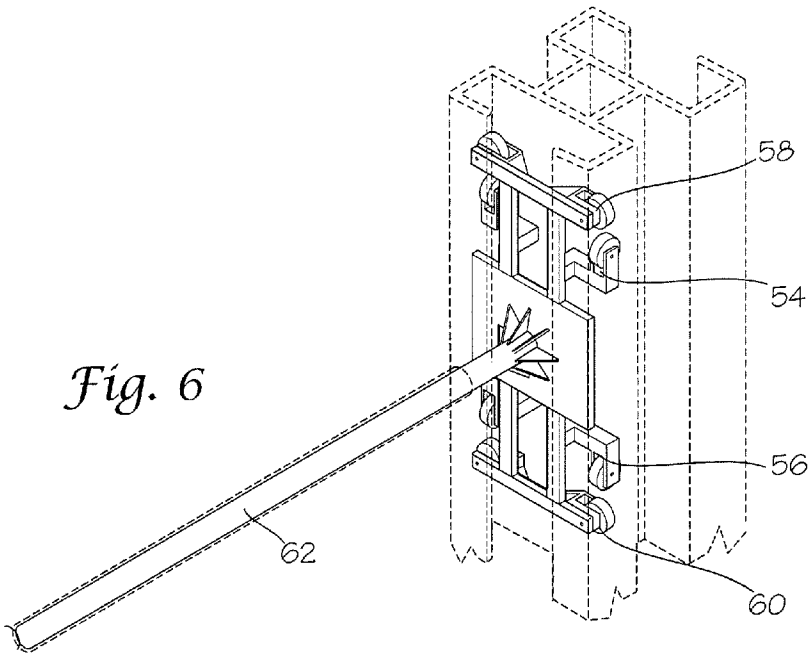
FIG. 6 shows a perspective view of a portion of the passenger carriage.

As can be seen in FIGS. 8 and 9, the passenger carriage 30 is pivotably connected to the trolley 46 by an axle 62 (FIG. 6). Through the use of ball bearings or other devices generally known in the art, the axle is rotatably mounted in the trolley 46 and allows the passenger carriage to be mounted on the axle. This pivotal connection allows the passengers to remain in an upright position as the free fall tower is transition from the erect free fall position to the loading position and vice versa.

Figure 10A:
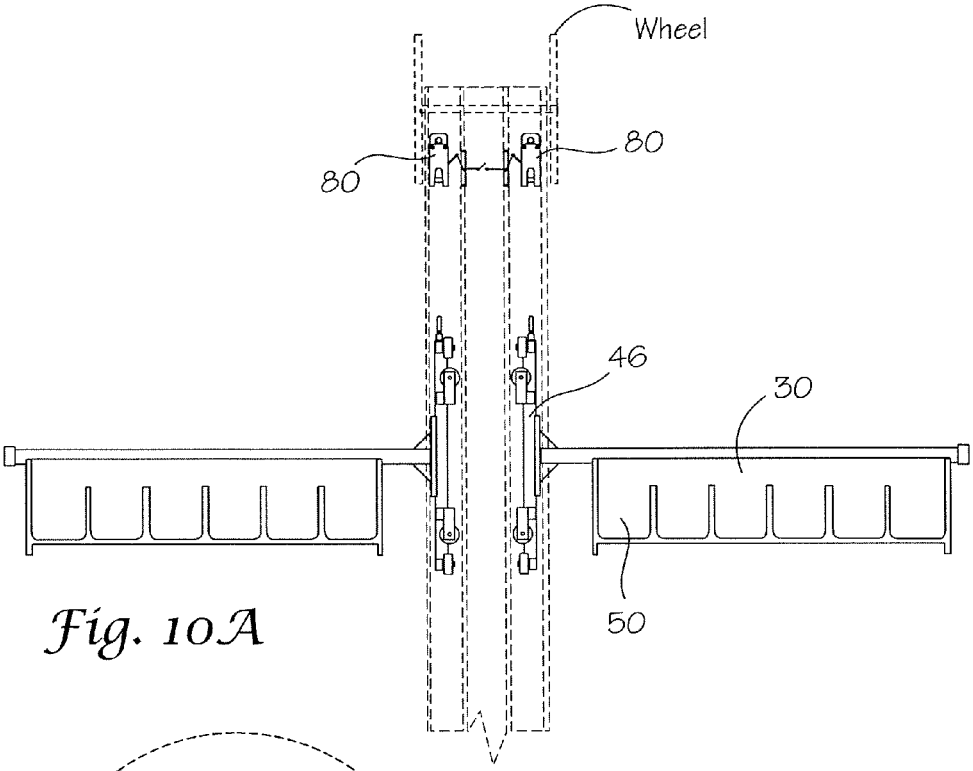
FIGS. 10A and 10B are side views of a portion of the invention.
Figure 10B:
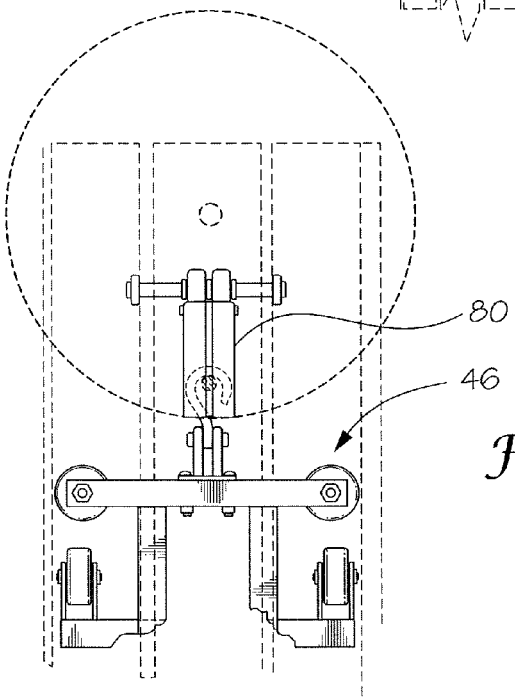

Referring now to FIG. 10A, the passenger carriage 30 and trolley 46 can be more clearly seen. The passenger carriage simply consists of several seating areas 50, each of which includes an appropriate restraint mechanism that is generally known in the art to ensure passenger safety. The passenger carriage 30 can further include safety shields 52 (FIG. 9) that are placed between the seating area and the trolley to ensure that passengers cannot come in contact with the trolley 46 or free fall tower. Carried by the upper portion of the free fall tower, a releasable latch 80 secures the trolley to a predetermined position along the tower. When the latch secures the trolley and the free fall tower rotates to the erect position, the trolley is positioned at the top of the free fall tower. When the latch is released, the trolley drops allowing the passengers in the passenger compartment to enjoy the ride. Latch 80 can be physically released, electronically released or wirelessly released.

In one embodiment, a single releasable latch is used to secure the passenger carriage at the distal end of the free fall tower when the free fall tower is in the free fall position. In one embodiment, a left and right section of the passenger carriage are independently carried by the free fall tower. The left and right sections of the passenger carriage each can be secured to the distal end of the free fall tower by releasable latches.

In one embodiment, the passenger carriage can be rotated to be disposed against the free fall tower for storage and transportation so that it is generally positioned along the upper portion of the free fall tower.

As shown in FIGS. 11A through 11D, the free fall tower may be placed in a compact, folded arrangement. The upper portion 20*b* of the free fall tower is hingedly connected to the lower portion 20*a* through hinge 82. In one embodiment, hinge 82 includes lower hinge portions 81*a* and 81*b* and upper hinge portion 83. A hinge pin 85 can be received by hinge portions 81*c*, 81*b* and 83 to form hinge 82. A hinge pin lock 87 can be included to secure the hinge pin in the upper and lower hinge portions.

Figure 11A:
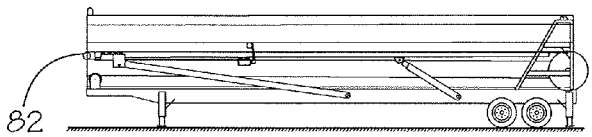
FIGS. 11A through 11D are side views of the invention in various arrangements; and, FIGS. 12A and 12B are perspective views of portions of the invention.
Figure 11B:
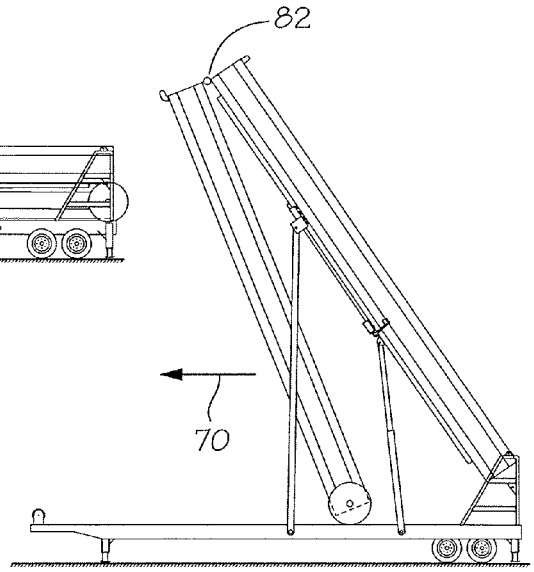
Figure 11C:
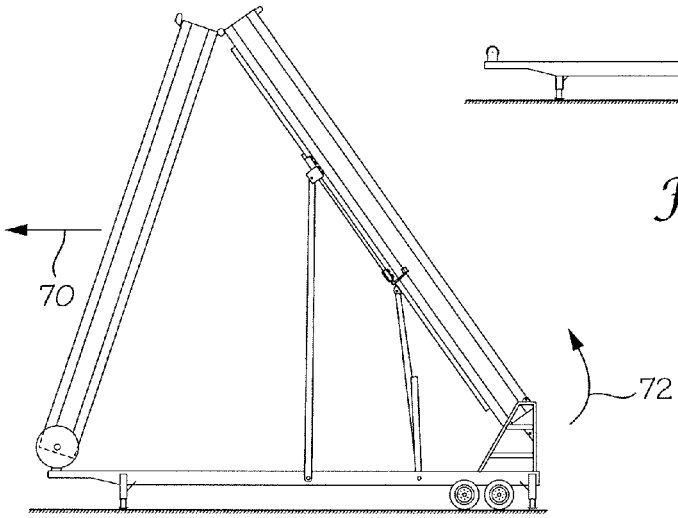
Figure 11D:
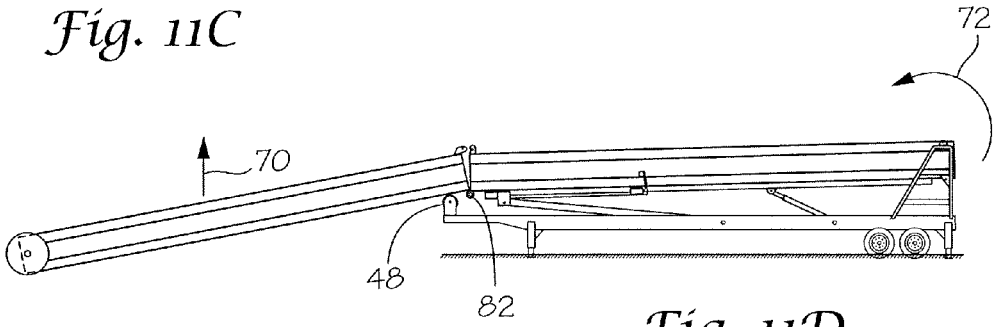

To transition the invention from its storage/transportation position to its operational position, first the free fall tower is raised as shown in FIG. 6B. Upper portion 20*b*, because it is pivotably connected to lower portion 20*a*, will swing in a direction shown as 70. Once the upper arm has cleared the base platform, it can be normally pulled further in direction 70. The free fall is then lowered. The upper portion will then continue to travel in direction 70 as lower portion rotates in direction 72 until the upper and lower portions are parallel. As shown in FIG. 11D, the lower portion continues to rotate downward and then upper portion comes in contact with roller 48. As the lower portion continues to rotate, the upper and lower portions are forced together. The two portions are then secured to form the extended free fall tower.

Figure 12A:
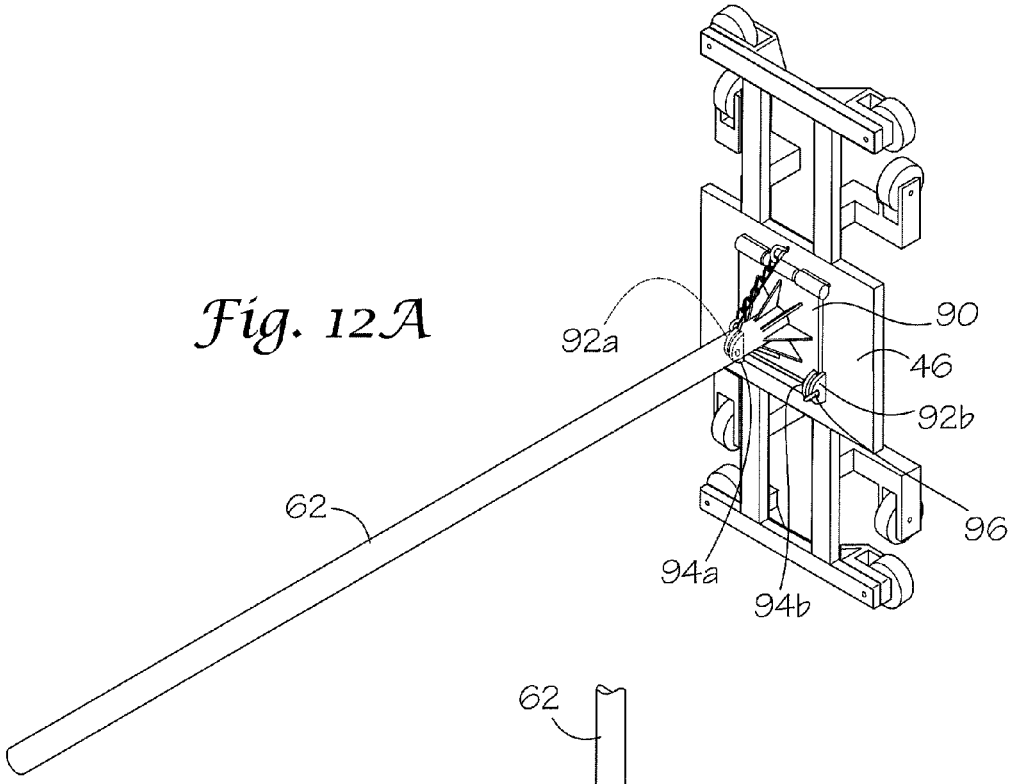
Figure 12B:
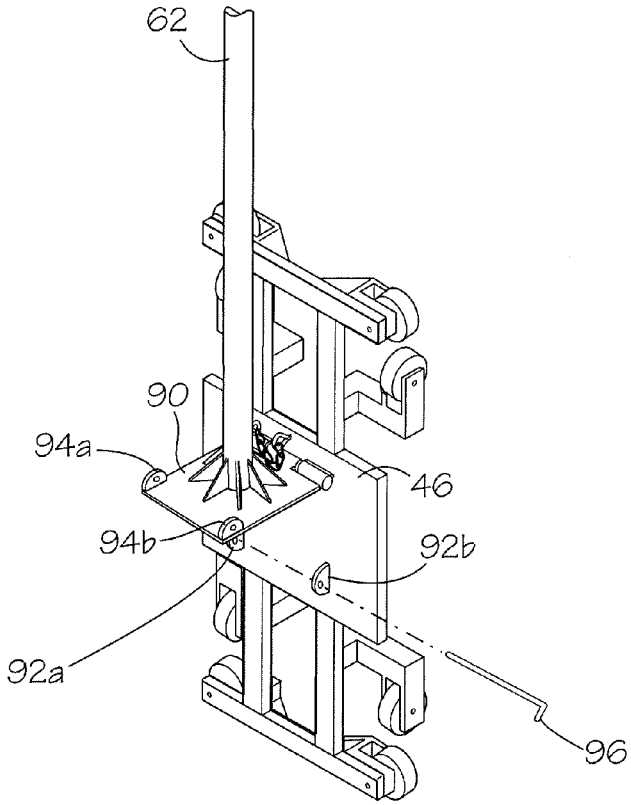

In one embodiment, tabs 64*a* and 64*b* (FIG. 2) align with tabs 66*a* and 66*b* when the free fall tower is fully extended. A pin 68 is placed between all the tabs securing the free fall tower in an extended position. A pin lock 71 can be used to secure pin 68. Referring to FIG. 6, axel 62 can be affixed to trolley 46 allowing the passenger carriage to be connected to the trolley and pivot about axel 62. Referring to FIG. 12A, an axel support plate can be hingedly attached to trolley 46 allowing the axel to transition between generally perpendicular and generally parallel to the trolley. Therefore, the axel and passenger carriage can be arranged perpendicular to the free fall tower for operation and parallel to the free fall tower for transportation and storage. Axel plate 90 can include axel plate eyelets 94*a* and 94*b*. Trolley can include trolley eyelets 92*a* and 92*b*. Pin 96 can be received by the axel plate eyelets and trolley eyelets securing the axel plate to the trolley.

While a preferred embodiment of the invention has been described using specific terms, such description is for illustrative purposes only, and it is to be understood that changes and variations may be made without departing from the spirit or scope of the following claims.

What is claimed is:

1. An amusement ride comprising:

a free fall tower hingedly attached to a mobile base platform having a distal end and a proximate end;

a lifting assembly connected to said mobile base platform and said free fall tower for transitioning said free fall tower from a loading position and a free fall position;

a passenger carriage slideably attached to said free fall tower and releasably connected to said distal end so that passengers can board said passenger carriage when said free fall tower is in said loading position;

a braking assembly carried by said free fall tower for stopping said passenger carriage when said passenger carriage is released from said distal end and said free fall tower is in said free fall position; and, a trolley disengagement arm connected to said mobile base platform and slideably connected to said free fall tower so that said trolley disengagement arm moves said passenger carriage outside a braking zone as said free fall tower transitions from said free fall position to said loading position.

2. The amusement ride of claim 1 including:

an upper free fall tower portion hingedly connected to a lower free fall portion so that said free fall tower can be rotated into a folded arrangement for storage or transportation.

3. The amusement ride of claim 1 including a trolley pivotably connected to said passenger carriage so that said passengers' orientation remains generally upright as said free fall tower transitions from said loading position to said free fall position.

4. The amusement ride of claim 1 including a track carried by said free fall tower and associated with a trolley disengagement arm for allowing said trolley disengagement arm to slide along said free fall tower.

5. The amusement ride of claim 1 including a releasable latch carried at said distal end of said free fall tower for securing said passenger carriage to said distal end when said free fall tower is in said loading position and transitioning to said free fall position.

6. The amusement ride of claim 1 wherein said braking assembly is a plurality of magnets.

7. An amusement ride apparatus comprising:

a free fall tower hingedly attached to a mobile base platform and having a proximal end and a distal end;

a lifting assembly connected to said base platform and said free fall tower for transitioning between a loading position and a free fall position;

a trolley slideably attached to said free fall tower;

a releasable latch carried by said distal end of said tower for securing said trolley to said distal end prior to said free fall tower transitioning from said loading position to said free fall position so that said trolley is held at said distal end when said tower is in said free fall position;

a braking assembly carried by said free fall tower for slowing said downward movement of said trolley when said trolley securing member is released; and, a passenger carriage pivotably carried by said trolley allowing said passenger carriage to pivot to maintain a generally upright orientation as said free fall tower transitions from said loading position to said free fall position.

8. The amusement ride of claim 7 further including a trolley disengaging arm slideably carried by said free fall tower adapted to engage said trolley so that when said free fall tower is transitioning to said loading position, said trolley disengaging arm pushes said trolley towards said distal end of said free fall tower thus disengaging said trolley from said braking assembly.

9. The amusement device of claim 7 further including a track carried by said free fall tower and adapted to slideably secure a trolley disengaging arm to said free fall tower.

10. The amusement device of claim 7 wherein said free fall tower includes an upper portion hingedly connected to a lower portion so that said free fall tower can be placed in a folded arrangement.

11. An amusement ride comprising:

a mobile base platform;

a free fall tower having a proximal end hingedly attached to said base platform; a distal end included in said free fall tower;

a passenger carriage slideably carried by said free fall tower;

a lifting assembly connected to said base platform and said free fall tower so that said free fall tower can transition between a loading position and a free fall position;

a braking assembly defining a braking area along said free fall tower carried by said base platform for stopping said trolley from traveling the entire axis of said free fall tower when said passenger carriage is allowed to drop from said distal end of said free fall tower toward said proximal end of said free fall tower when said free fall tower is in said free fall position; and, a trolley disengaging arm that is slideably carried by said free fall tower and is adapted to engage said passenger carriage so that when said free fall tower is transitioning into said loading position, said lifting assembly pushes said passenger carriage toward said distal end of said free fall tower causing said passenger carriage to move out of said braking area.

12. The amusement ride of claim 11 wherein said braking assembly is a plurality of magnets carried by said free fall tower.

13. The amusement ride of claim 11 wherein said passenger carriage is pivotably carried by said free fall tower allowing said passenger carriage to pivot to maintain a generally upright orientation in relation to said base platform as said free fall tower moves from said loading position to said free fall position.

14. The apparatus of claim 11 including a track carried by said free fall tower to slideably secure said trolley disengaging arm to said free fall tower.

15. The apparatus of claim 11 wherein said free fall tower includes an upper portion hingedly connected to a lower portion so that said free fall tower can be placed in a folded arrangement.

16. The amusement ride of claim 15 including a roller assembly carried by said mobile base platform operably associated with said upper portion of said free fall tower extending said upper and said lower portions of said free fall tower when said lower portion of said free fall tower is rotated downward.

17. An amusement ride comprising:

a base platform;

a free fall tower pivotably connected to said base platform;

a passenger carriage slideably carried by said free fall tower;

a releasable latch carried by a distal end of said free fall tower for securing said passenger carriage to said distal end of said free fall tower;

said free fall tower having a loading position wherein said free fall tower is generally parallel with said base platform and a free fall position wherein said free fall tower is generally perpendicular to said base platform; and, an upper portion of said free fall tower hingedly connected to a lower portion of said free fall tower so that said free fall tower can be placed in a folded arrangement.

18. The amusement ride of claim 17 including a lifting assembly connected to said base platform 18 and for transitioning said free fall tower between said loading and said free fall position.

19. The amusement ride of claim 17 including a braking assembly carried by said free fall tower for stopping said passenger carriage from traveling the full length of said free fall tower when said passenger carriage drops from said distal end toward said proximal end of said free fall tower.

20. The amusement ride of claim 17 wherein said base platform is mobile.

21. The apparatus of claim 17 wherein said loading position includes positioning said distal end lower than said proximal end.

* * * * *